United States Patent [19]

Nicyper

[11] Patent Number: 4,974,326

[45] Date of Patent: Dec. 4, 1990

[54] GUIDE-PIN

[76] Inventor: Raymond Nicyper, 73 Birch Hill, Weston, Conn. 06880

[21] Appl. No.: 206,868

[22] Filed: Jun. 9, 1988

[51] Int. Cl.[5] ..... B43L 13/10

[52] U.S. Cl. ..... 33/25.2; 33/42; 33/25.1; 33/23.01; 33/23.11

[58] Field of Search ..... 33/23.01, 23.02, 23.04, 33/23.06, 23.07, 23.10, 23.11, 25.1, 25.2, 25.3, 25.4, 25.5, 27.03, 1 K, 42

[56] References Cited

U.S. PATENT DOCUMENTS

| | | | |
|---|---|---|---|
| 197,885 | 12/1877 | Page | 33/25.1 |
| 406,796 | 7/1889 | Ulber | 33/23.02 |
| 834,470 | 10/1906 | Hanssen | 33/25.1 |
| 938,936 | 11/1909 | Ziegler | 33/25.2 |
| 1,392,125 | 9/1921 | Dudash et al. | 33/42 |
| 1,496,889 | 6/1924 | Kay | 33/25.2 |
| 2,027,774 | 1/1936 | Hewel | 33/42 |
| 2,041,022 | 5/1936 | Rassmussen | 33/42 |
| 2,411,718 | 11/1946 | Feld | 33/25.2 |
| 2,835,974 | 5/1958 | Wilkinson et al. | 33/23.01 |
| 4,397,090 | 8/1983 | Nicyper | 33/25.1 |

*Primary Examiner*—William A. Cuchlinski, Jr.
*Assistant Examiner*—Patrick R. Scanlon
*Attorney, Agent, or Firm*—Michael J. Striker

[57] ABSTRACT

A guide-pin for use in tracing templates and stencils, having a first portion, a second portion and a third portion, the guide-pin having a single piece construction. The second portion and the third portion extend in a common plane and hold the first portion perpendicular to the common plane. The first portion is inserted vertically into a pantograph arm opening. The second and third portions are secured against the pantograph arm.

8 Claims, 1 Drawing Sheet

GUIDE-PIN

BACKGROUND OF THE INVENTION

The present invention relates generally to a guide-pin for tracing templates and stencils when used on a permanently-set pantograph.

In the prior art as exemplified by U.S. Pat. No. 4,397,090 by the present inventor, tracing was effected by using pantographs having an adjustable sliding pivot mechanisms that had to be set.

In order to eliminate these pivot mechanisms when tracing images on a flat surface, the present inventor also previously devised a pantograph as shown in FIGS. 2 and 3 (but without the guide-pin). The pantograph is transparent and has a plurality of openings, each indicative of a different ratio for enlarging and reducing the size of the image.

The pantograph has four arms arranged to form a parallelogram having a pivot at each corner of the parallelogram, one of the arms constituting an enlarging ratio arm and another arm constituting a reducing ratio arm. The enlarging ratio arm has an extended portion which extends beyond a first pivot. This extended portion has a plurality of openings spaced apart from each other by unequal spacings. Each opening represents a different enlargement ratio, the values of which increase the further away from the pivot point the corresponding opening is located. The reducing ratio arm is pivoted at that same first pivot and has a plurality of openings spaced apart from each other by unequal spacings, each opening representing different reduction ratios with values that are reciprocals respectively of the enlargement ratios.

To enlarge a size of an original image, a desired proportion making opening of the enlarging ratio arm is placed over a planned image point. A corresponding reciprocable ratio opening in the reduction ratio arm is located over a corresponding original image point; this opening serves as a sight hole. The enlargement ratio arm is guided and moved relative to the other arms and an image is then marked while one concentrates on the original image being traced through the sight hole. A third arm, which is also pivoted with the enlargement ratio arm, should be fastened to the work surface.

To reduce the size of an original image, a mark is made through a selected ratio opening in the reduction ratio arm to draw a resized image while sighting and following the original image through the reciprocal ratio opening in the enlargement ratio arm. A guide knob can be secured to another opening in the enlargement ratio arm to better control the tracing. The third arm is also fastened to the work surface.

The fastening of the third arm can be effected by extending a shaft of a pivot tack through an end opening at an end of the third arm such that its tack head rests on top. The shaft is further inserted through a pivot base immediately underneath the end opening and into the work surface.

Alternatively, the shaft of the pivot tack is extended through the pivot base and through the end opening from the underside of the third arm. The shaft is then fed into a throughgoing hole in a pivot knob, which is made of elastic material and has a diameter smaller than that of the shaft of the pivot tack. The pivot base is taped to the working surface or, for brief enlarging operations, the guide knob is pressed down to retain this entire assembly in place against the working surface.

SUMMARY OF THE INVENTION

It is the object of the present invention to provide a device for tracing templates and stencils that is an improvement over the prior art.

In keeping with this object, and others which will become apparent hereafter, one aspect of the invention resides, briefly stated, in a guide-pin for tracing templates and stencils, the guide-pin having a first portion formed to cooperate with a pantograph for tracing templates and stencils and a second and a third portion extending in a common plane. The second and third portions hold the first portion perpendicular to the common plane.

Another aspect of the present invention includes a pantograph arm with a plurality of openings. The first portion of the guide-pin extends through a desired opening in the pantograph for tracing.

A further aspect of the invention includes a tack and a guide knob formed of neoprene rubber or of a soft synthetic. The guide knob has a centrally extending hole with a diameter smaller than that of a shaft of the tack. The shaft is inserted through another opening in the pantograph arm from the underside of the pantograph. The second and third portions are arranged on the pantograph upper surface so that the tack extends between them. The shaft is then inserted into the hole of the guide knob, elastically deforming the same. The guide knob presses the second and third portions firmly against the pantograph arm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
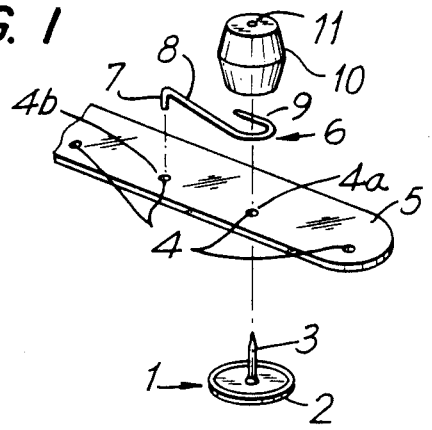
FIG. 1 is an exploded view showing how the present invention is to be assembled.
Figure 2:
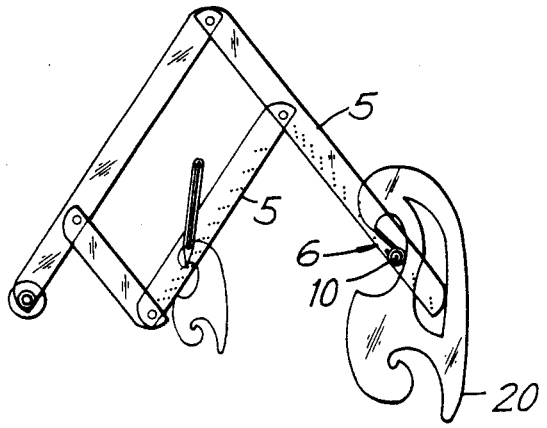
FIG. 2 is a top view of the present invention in position for reducing.
Figure 3:
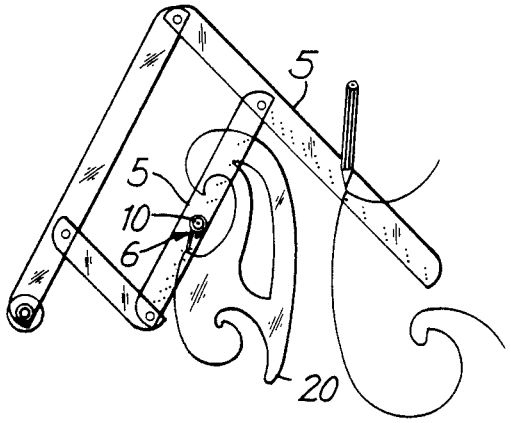
FIG. 3 is a top view of the present invention in position for enlarging.

Referring now to the drawings, a tack 1 is shown that has a head 2 and a shaft 3 extending from the head 2. The shaft 3 is inserted through an opening **4*a* in a pantograph arm 5 that is adjacent to a desired opening 4*b* for tracing. The pantograph arm 5 has a plurality of openings 4, each one representing a different tracing ratio for either enlarging, reproducing or reducing the size of a stencil or template 20. The spacing between openings 4** varies proportionally in dependence upon the difference between the ratios represented by the openings and so the openings are not necessarily spaced apart equally.

A guide-pin 6 is provided which has a first bent portion 7 protruding through the desired opening **4*b* far enough to permit tracing or the following along an edge of the stencils and templates 20. The guide-pin also has a second portion 8 extending from the first bent portion 7 to a third portion 9. A loop is formed between the second and third portions and loops around the shaft 3**. Preferably, the guide-pin is metallic and formed to elastically retain its shape under manual pressure.

A hole 11 extends longitudinally through all of the guide knob 10. The guide knob 10 is pressed onto the shaft 3 by insertion of the shaft 3 into the hole 11 until the bottom face of the guide knob 10 firmly presses the second and third portions 8, 9 against the upper surface of the pantograph arm 3. The guide knob 10 is preferably made of an elastically resilient material such as neoprene rubber or a soft synthetic.

The hole 11 in the guide knob 10 has a diameter smaller than a diameter of the shaft; thus, the shaft 3 compresses the elastic material of the guide knob 10 outward upon insertion into the hole 11, effectively causing the guide knob 10 to grab onto the shaft 3. Preferably, the diameter of the hole 11 through the guide knob 10 is one half that of the shaft 3 of the tack 1.

It is very important that the first bent portion 7 of the guide-pin 6 protrude through the desired opening **4*b* in the pantograph arm 5 perpendicularly to the surface on which the sketch or tracing is made in order to ensure that the tracing is accurate. This perpendicular alignment is obtained by extending the second portion 8 and the third portion 9 in a common plane so as to rest these two portions on the flat upper surface of the pantograph arm 5 during assembly. Thus, the guide-pin 6 is prevented from twisting, which would otherwise cause the first bent portion 7 to extend through the desired opening 4*b*** at a skewed angle off the perpendicular.

A bottom face of the guide knob 10, which faces the pantograph arm 5, must be wide enough to press the second and third portions 8, 9 of the guide-pin 6 into place against the upper surface of the pantograph arm 5.

For simplicity of assembly, the guide-pin is shown in the preferred embodiment looping around the shaft. It should be understood that other fastening arrangements are possible other than a tack and curved area combination; the main idea is to ensure that the first bent portion protrudes through the desired opening in a vertical manner at all times.

The distance between adjacent openings 4 on the pantograph arm 5 varies so that at least one pair of adjacent openings are separated from each other by a spacing that is greater in distance than the other spacings. Thus, the third portion must extend far enough from the loop so that this greatest spacing distance can be accommodated. In this manner, the guide knob 10 will be able to press the second and third portions firmly against the pantograph arm 5.

It will be understood that each of the elements described above, or two or more together, may also find a useful application in other types of guide pins differing from the types described above.

While the invention has been illustrated and described as embodied in a guide-pin, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for the various applications without omitting features that, from the standpoint of prior art, fairly constitute essential characteristics of the generic or specific aspects of this invention.

What is desired to be protected by Letters Patent is set forth in the appended claims.

I claim:

1. An assembly for use in tracing templates and stencils, comprising:

a pantograph arm having a plurality of openings spaced apart from each other;

a guide-pin having a single piece construction with a first, a second and a third portion, said first portion being extendable through a number of said openings, said second and third portions being extendable in a common plane to hold said first portion so that said first portion extends perpendicular to said common plane through one of said openings; and means for securing said second and third portions at another of said openings so that said first portion extends through said one of said openings.

2. The assembly as defined in claim 1, wherein said securing means includes a shaft and a guide knob, said guide knob having a hole passing through longitudinally, said shaft being extended through said another of said openings and being inserted into said hole of said guide knob, said second portion and said third portion being arranged between said pantograph arm and said guide knob, said guide knob being arranged to firmly press said second and third portions against said pantograph arm so as to retain said second and third portions in position.

3. The assembly as defined in claim 2, wherein said shaft is formed as part of a tack with a head wider than a diameter of said another opening.

4. The assembly as defined in claim 2, wherein said hole in said guide knob has a diameter smaller than a diameter of said shaft.

5. The assembly as defined in claim 2, wherein said guide knob is formed of an elastic material.

6. The assembly as defined in claim 1, wherein said plurality of openings are unequally spaced apart from each other so as to form a plurality of spacings in which one of said spacings is larger than a remainder of said spacings, said guide-pin including a curved area between said second and third portions, said third portion having an end spaced from said curved area by a distance at least as great as said one spacing.

7. A method for preparing for tracing templates and stencils, comprising the steps of:

inserting a first portion of a guide-pin through a desired opening in a pantograph arm;

extending a second and a third portion of the guide-pin in a common plane on the pantograph arm;

holding the first portion by the second and third portions so that the first portion extends perpendicular to the common plane, the guide-pin having a single piece construction; and securing the second and third portions of the guide-pin to the pantograph arm at another opening in the pantograph arm.

8. The method as defined in claim 7, wherein the securing includes inserting a shaft of a tack through the another opening and into a hole passing longitudinally through a guide knob, the guide knob being composed of an elastic material which compresses in response to insertion of the shaft in the hole so as to grab onto the shaft, the securing also including arranging the second portion and the third portion between the guide knob and the pantograph arm and forcing the shaff further into the hole in the guide knob so that the guide knob presses the second and third portions against the pantograph arm to thereby retain the guide-pin in position.

* * * * *